US010008214B2

(12) United States Patent
Beack et al.

(10) Patent No.: US 10,008,214 B2
(45) Date of Patent: Jun. 26, 2018

(54) USAC AUDIO SIGNAL ENCODING/DECODING APPARATUS AND METHOD FOR DIGITAL RADIO SERVICES

(71) Applicant: Electronics and Telecommunications Research Institute, Daejeon (KR)

(72) Inventors: Seung Kwon Beack, Daejeon (KR); Tae Jin Lee, Daejeon (KR); Jong Mo Sung, Daejeon (KR); Kyu Tae Yang, Daejeon (KR); Bong Ho Lee, Daejeon (KR); Mi Suk Lee, Daejeon (KR); Hyoung Soo Lim, Daejeon (KR); Jin Soo Choi, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days. days.

(21) Appl. No.: 15/260,717

(22) Filed: Sep. 9, 2016

(65) Prior Publication Data

US 2017/0076735 A1 Mar. 16, 2017

(30) Foreign Application Priority Data

Sep. 11, 2015 (KR) ..... 10-2015-0129124
Apr. 29, 2016 (KR) ..... 10-2016-0053168

(51) Int. Cl.
*G10L 19/18* (2013.01)
*G10L 19/16* (2013.01)

(52) U.S. Cl.
CPC ..... *G10L 19/167* (2013.01); *G10L 19/18* (2013.01)

(58) Field of Classification Search
None
See application file for complete search history.

(56) References Cited

U.S. PATENT DOCUMENTS

2007/0225971 A1* 9/2007 Bessette ..... G10L 19/0208 704/203
2010/0073562 A1* 3/2010 Miyoshi ..... H03G 3/3005 348/563
2010/0106511 A1* 4/2010 Shirakawa ..... G10L 19/02 704/500

(Continued)

OTHER PUBLICATIONS

"Digital Audio Broadcasting (DAB); Transport of Advanced Audio Coding (AAC) audio," ETSI TS 102 563, Feb. 2007, pp. 1-26, V1.1.1.

*Primary Examiner* — Paras D Shah
*Assistant Examiner* — Thuykhanh Le
(74) *Attorney, Agent, or Firm* — William Park and Associates Ltd.

(57) ABSTRACT

Disclosed is a unified speech and audio coding (USAC) audio signal encoding/decoding apparatus and method for digital radio services. An audio signal encoding method may include receiving an audio signal, determining a coding method for the received audio signal, encoding the audio signal based on the determined coding method, and configuring, as an audio superframe of a fixed size, an audio stream generated as a result of encoding the audio signal, wherein the coding method may include a first coding method associated with extended high-efficiency advanced audio coding (xHE-AAC) and a second coding method associated with existing advanced audio coding (AAC).

11 Claims, 6 Drawing Sheets

(56) References Cited

U.S. PATENT DOCUMENTS

2010/0329360 A1 12/2010 Jung et al.
2011/0320196 A1* 12/2011 Choo ..... G10L 19/20
704/229
2012/0209600 A1* 8/2012 Kim ..... G10L 19/025
704/219
2012/0245947 A1* 9/2012 Neuendorf ..... G10L 19/20
704/500
2012/0265541 A1* 10/2012 Geiger ..... G10L 19/0212
704/500
2014/0019146 A1* 1/2014 Neuendorf ..... G10L 19/008
704/500
2014/0074487 A1 3/2014 Seo et al.
2015/0117653 A1* 4/2015 Gao ..... G10L 25/69
381/56
2015/0134328 A1* 5/2015 Beack ..... G10L 19/022
704/219
2015/0142452 A1* 5/2015 Sung ..... G10L 19/005
704/500
2015/0332696 A1* 11/2015 Fuchs ..... G10L 19/028
704/500
2015/0332701 A1* 11/2015 Nagel ..... G10L 21/0388
704/500
2016/0104487 A1* 4/2016 Schnabel ..... G10L 19/005
704/219
2016/0140974 A1* 5/2016 Valero ..... G10L 19/028
381/22
2016/0210970 A1* 7/2016 Ekstrand ..... G10L 21/0388
2017/0134873 A1* 5/2017 Beack ..... H04S 3/008

* cited by examiner

USAC AUDIO SIGNAL ENCODING/DECODING APPARATUS AND METHOD FOR DIGITAL RADIO SERVICES

CROSS-REFERENCE TO RELATED APPLICATION(S)

This application claims the priority benefit of Korean Patent Application No. 10-2015-0129124 filed on Sep. 11, 2015, and Korean Patent Application No. 10-2016-0053168 filed on Apr. 29, 2016, in the Korean Intellectual Property Office, the disclosures of which are incorporated herein by reference for all purposes.

BACKGROUND

1. Field

One or more example embodiments relate to a unified speech and audio coding (USAC) audio signal encoding/decoding apparatus and method for digital radio services, and more particularly, to an apparatus and method for determining a coding method for an audio signal and encoding or decoding the audio signal based on the determined coding method.

2. Description of Related Art

Unified speech and audio coding (USAC) is audio codec technology for which standardization was completed in a moving picture experts group (MPEG) in 2012. The USAC obtains improved performance in a speech or audio signal, compared to existing technology, for example, high-efficiency advanced audio coding version 2 (HE-AAC v2) and extended adaptive multi-rate wideband (AMR-WB+), and is highly applicable as next-generation codec technology.

There was a digital audio broadcasting (DAB) transmission method for digital radio services. Also, an upgraded DAB (DAB+) transmission method that was subsequently introduced may improve audio codec technology that was used for DAB and provide higher-quality digital radio services. Provided herein is a bitstream structure and a framing method that are needed for application of recent USAC audio codec technology to the DAB+, and that may improve a digital radio service in the future.

SUMMARY

An aspect provides a unified speech and audio coding (USAC) based audio signal encoding or decoding apparatus and method for a digital radio service, and the USAC based audio signal encoding or decoding apparatus and method may provide syntactic information and a frame structure for additional application of USAC to existing upgraded digital audio broadcasting (DAB+), and thus may enable a USAC based DAB+ service.

According to an aspect, there is provided an audio signal encoding method including receiving an audio signal, determining a coding method for the received audio signal, encoding the audio signal based on the determined coding method, and configuring, as an audio superframe of a fixed size, an audio stream generated from the encoding of the audio signal. The coding method may include a first coding method associated with extended high-efficiency advanced audio coding (xHE-AAC) and a second coding method associated with existing advanced audio coding (AAC).

The receiving may include determining whether a type of the received audio signal is a multichannel audio signal or a mono or stereo audio signal, and performing moving picture experts group (MPEG) surround (MPS) encoding on the received audio signal when the received audio signal is determined to be the multichannel audio signal.

When the coding method for the received audio signal is determined to be the first coding method, the encoding may include performing MPS212 encoding, a tool for the MPS encoding, on the received audio signal, performing enhanced spectral band replication (eSBR) on an audio signal output from the performing of the MPS212 encoding, and performing core encoding on an audio signal output from the performing of the eSBR.

When the coding method for the received audio signal is determined to be the second coding method, the encoding may include performing parametric stereo (PS) and spectral band replication (SBR) on the received audio signal, and performing encoding on an audio signal output from the performing of the PS and SBR using the second coding method.

The audio superframe may include a header section including information about a number of borders of audio frames included in the audio superframe and information about a reservoir fill level of a first audio frame, a payload section including bit information of the audio frames included in the audio superframe, and a directory section including border location information of a bit string for each audio frame included in the audio superframe.

The audio signal encoding method may further include applying forward error correction (FEC) to the audio superframe. The applying may include correcting a bit error occurring when the audio superframe is being transmitted through a communication line.

According to another aspect, there is provided an audio signal encoding apparatus including a receiver configured to receive an audio signal, a determiner configured to determine a coding method for the received audio signal, an encoder configured to encode the audio signal based on the determined coding method, and a configurer configured to configure, as an audio superframe of a fixed size, an audio stream generated from the encoding of the audio signal. The coding method may include a first coding method associated with xHE-AAC and a second coding method associated with existing AAC.

When the coding method for the received audio signal is determined to be the first coding method, the encoder may perform MPS 212 encoding on the received audio signal, perform eSBR on an audio signal output from the performing of the MPS212 encoding, and perform core encoding on an audio signal output from the performing of the eSBR.

When the coding method for the received audio signal is determined to be the second coding method, the encoder may perform PS and SBR on the received audio signal, and perform encoding on an audio signal output from the performing of the PS and SBR using the second coding method.

The audio superframe may include a header section including information about a number of borders of audio frames included in the audio superframe and information about a reservoir fill level of a first audio frame, a payload section including bit information of the audio frames included in the audio superframe, and a directory section including border location information of a bit string for each audio frame included in the audio superframe.

According to still another aspect, there is provided an audio signal decoding method including receiving an audio superframe, determining a decoding method for an audio signal based on the received audio superframe, and decoding the audio superframe based on the determined decoding method. The decoding method may include a first decoding method associated with xHE-AAC and a second decoding method associated with existing AAC.

The determining may include extracting a decoding parameter from the received audio superframe, and determining at least one decoding method of the first decoding method and the second decoding method based on the extracted decoding parameter.

The decoding parameter may be automatically determined based on a user parameter used for encoding the audio signal, and the user parameter may include at least one of bit rate information of a codec for the audio signal, layout type information of the audio signal, and information as to whether MPS encoding is used for the audio signal.

When the decoding method for the received audio superframe is determined to be the first decoding method, the decoding may include performing core decoding on the received audio superframe, performing eSBR on an audio signal output from the performing of the core decoding, and performing MPS212 decoding on an audio signal output from the performing of the eSBR.

When the decoding method for the received audio superframe is determined to be the second decoding method, the decoding may include performing decoding on the received audio superframe using the second decoding method, and performing PS and SBR on an audio signal output from the performing of the second decoding method.

The audio superframe may include a header section including information about a number of borders of audio frames included in the audio superframe and information about a reservoir fill level of a first audio frame, a payload section including bit information of the audio frames included in the audio superframe, and a directory section including border location information of a bit string for each audio frame included in the audio superframe.

According to yet another aspect, there is provided an audio signal decoding apparatus including a receiver configured to receive an audio superframe, a determiner configured to determine a decoding method for an audio signal based on the received audio superframe, and a decoder configured to decode the audio superframe based on the determined decoding method. The decoding method may include a first decoding method associated with xHE-AAC and a second decoding method associated with existing AAC.

The determiner may extract a decoding parameter from the received audio superframe, and determine at least one decoding method of the first decoding method and the second decoding method.

The decoding parameter may be automatically determined based on a user parameter used for encoding the audio signal, and the user parameter may include bit rate information of a codec for the audio signal, layout type information of the audio signal, and information as to whether MPS encoding is used for the audio signal.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the present disclosure will become apparent and more readily appreciated from the following description of example embodiments, taken in conjunction with the accompanying drawings of which.

DETAILED DESCRIPTION

Figure 1:
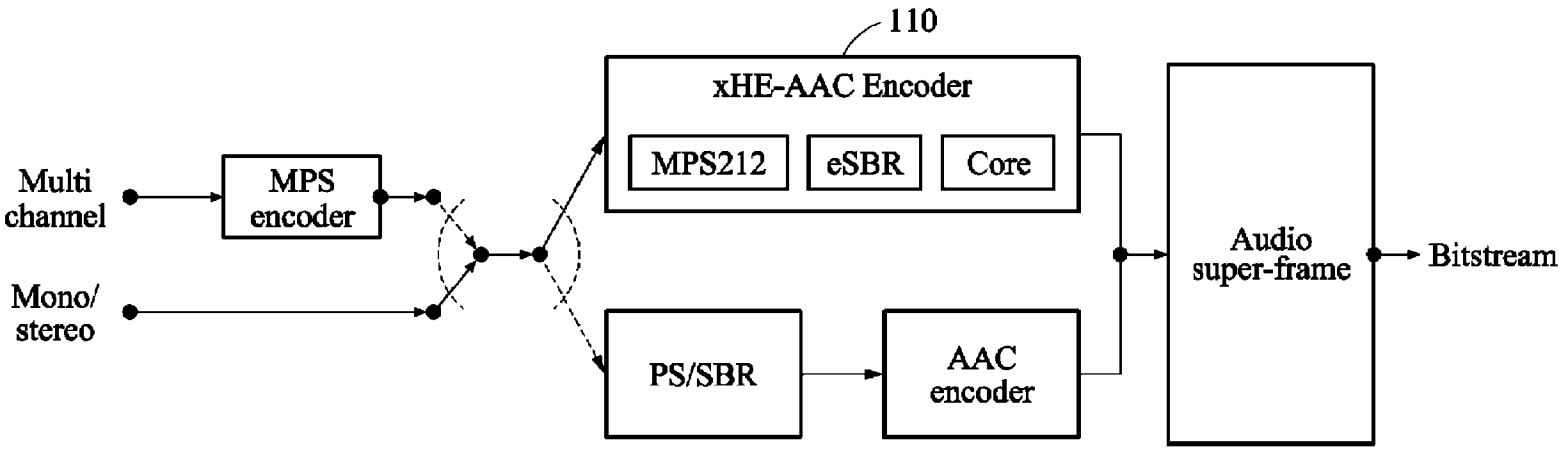
FIG. 1 is a diagram illustrating an encoding system of extended high-efficiency advanced audio coding (xHE-AAC) according to an example embodiment.

Detailed example embodiments of the inventive concepts are disclosed herein. However, specific structural and functional details disclosed herein are merely representative for purposes of describing example embodiments of the inventive concepts. Example embodiments of the inventive concepts may, however, be embodied in many alternate forms and should not be construed as limited to only the embodiments set forth herein.

Accordingly, while example embodiments of the inventive concepts are capable of various modifications and alternative forms, embodiments thereof are shown by way of example in the drawings and will herein be described in detail. It should be understood, however, that there is no intent to limit example embodiments of the inventive concepts to the particular forms disclosed, but to the contrary, example embodiments of the inventive concepts are to cover all modifications, equivalents, and alternatives falling within the scope of example embodiments of the inventive concepts.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the inventive concepts. As used herein, the term "and/or" includes any and all combinations of one or more of the associated listed items.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments of the inventive concepts. As used herein, the singular forms "a," "an," and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms, including technical and scientific terms, used herein have the same meaning as commonly understood by one of ordinary skill in the art to which this disclosure pertains. Terms, such as those defined in commonly used dictionaries, are to be interpreted as having a meaning that is consistent with their meaning in the context of the relevant art, and are not to be interpreted in an idealized or overly formal sense unless expressly so defined herein.

Hereinafter, example embodiments will be described in detail with reference to the accompanying drawings. Regarding the reference numerals assigned to the elements in the drawings, it should be noted that the same elements will be designated by the same reference numerals, wherever possible, even though they are shown in different drawings.

Hereinafter, extended high-efficiency advanced audio coding (xHE-AAC) will be used in place of unified speech and audio coding (USAC) because the USAC is actually defined in an xHE-AAC profile, and the USAC and high-efficiency advanced audio coding version 2 (HE-AAC v2) may be simultaneously supported when using the xHE-AAC profile. Thus, the xHE-AAC described herein may be construed as being the USAC.

FIG. 1 is a diagram illustrating an encoding system of xHE-AAC according to an example embodiment.

To transmit an xHE-AAC audio stream through a digital audio broadcasting (DAB) network, a profile suitable for a scope and a characteristic of a parameter of an xHE-AAC audio codec may need to be defined. In addition, to multiplex and transmit a compressed xHE-AAC audio stream through a main DAB service channel, an xHE-AAC encoding apparatus may configure the compressed xHE-AAC audio stream as an audio superframe and transmit the configured audio superframe based on an actual transmission condition.

Further, to ensure robust transmission of the xHE-AAC audio stream, the encoding apparatus may need to additionally apply forward error correction (FEC), and an xHE-AAC decoding apparatus may need to support an upgraded DAB (DAB+) audio stream decoding function that applies HE-AAC v2.

An example of an xHE-AAC based encoding system is illustrated in FIG. 1. An audio signal may be encoded by selecting one from an xHE-AAC based coding method (first coding method) and an existing advanced audio coding (AAC) based coding method (second coding method). The encoding system may determine a coding method for an audio signal based on a preset condition, and encode the audio signal based on the determined coding method.

The encoding system may determine whether a type of the audio signal is a multichannel audio signal or a mono or stereo signal. When the audio signal is determined to be the multichannel signal, the encoding system may perform moving picture experts group (MPEG) surround (MPS) encoding. The encoding system may perform encoding on a mono or stereo audio signal output by performing the MPS encoding.

When the coding method for the audio signal is determined to be the first coding method, the encoding system may perform MPS212 encoding, a tool for the MPS encoding, on the received audio signal, perform enhanced spectral band replication (eSBR) on an audio signal output by performing the MPS212 encoding, and perform core encoding on an audio signal output by performing the eSBR.

When the coding method for the audio signal is determined to be the second coding method, the encoding system may perform parametric stereo (PS) and spectral band replication (SBR) on the received audio signal, and perform encoding on an audio signal output by performing the PS and SBR using the second coding method.

Here, similarly to an existing AAC based coding tool, components of the xHE-AAC coding method may include SBR and a stereo coding tool to form a single xHE-AAC encoding block 110. Here, there may be a difference in stereo coding tool in that, although the AAC based coding tool may use a PS coding method, the xHE-AAC may provide an enhanced stereo sound quality using a stereo version MPS212. An SBR module of the xHE-AAC coding method may be defined and used as the eSBR with an addition of several functions.

Figure 2:
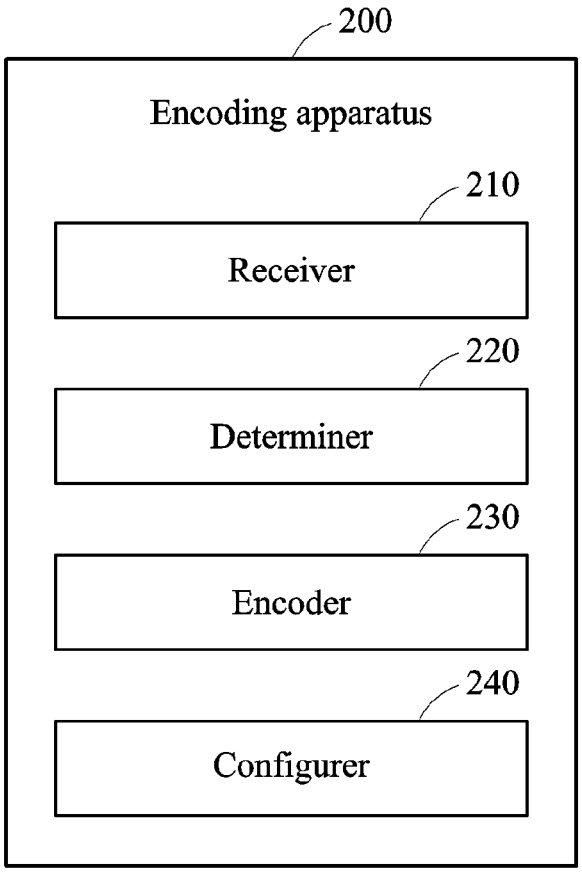
FIG. 2 is a diagram illustrating an encoding apparatus according to an example embodiment.

FIG. 2 is a diagram illustrating an encoding apparatus according to an example embodiment.

Referring to FIG. 2, an encoding apparatus 200 includes a receiver 210, a determiner 220, an encoder 230, and a configurer 240. The receiver 210 may receive an audio signal to be encoded. Here, the audio signal to be received by the receiver 210 may be a multichannel audio signal or a mono or stereo audio signal.

The receiver 210 may determine whether a type of the received audio signal is a multichannel audio signal or a mono or stereo audio signal. When the received audio signal is determined to be a multichannel audio signal, the receiver 210 may perform MPS encoding to convert the multichannel audio signal to a mono or stereo audio signal.

The determiner 220 may determine a coding method for the audio signal received through the receiver 210. The coding method may include a first coding method associated with xHE-AAC and a second coding method associated with existing AAC.

The encoder 230 may encode the received audio signal based on the coding method determined by the determiner 220. For example, when the coding method for the received audio signal is determined to be the first coding method, the encoder 230 may perform MPS212 encoding on the received audio signal, perform eSBR on an audio signal output by performing the MPS212 encoding, and perform core encoding on an audio signal output by performing the eSBR.

When the coding method for the received audio signal is determined to be the second coding method, the encoder 230 may perform PS and SBR on the received audio signal, and perform encoding on an audio signal output by performing the PS and SBR using the second coding method.

The configurer 240 may configure, as an audio superframe of a fixed size, an audio stream generated as a result of encoding the received audio signal. Here, the audio stream encoded by the first coding method may be configured as a single audio superframe in which a plurality of audio frames is not divided by a border, and the configured audio superframe may be transmitted.

An applier (not shown) may apply FEC to the audio superframe. The applier may correct a bit error that may occur when the audio superframe is being transmitted through a communication line.

Figure 3:
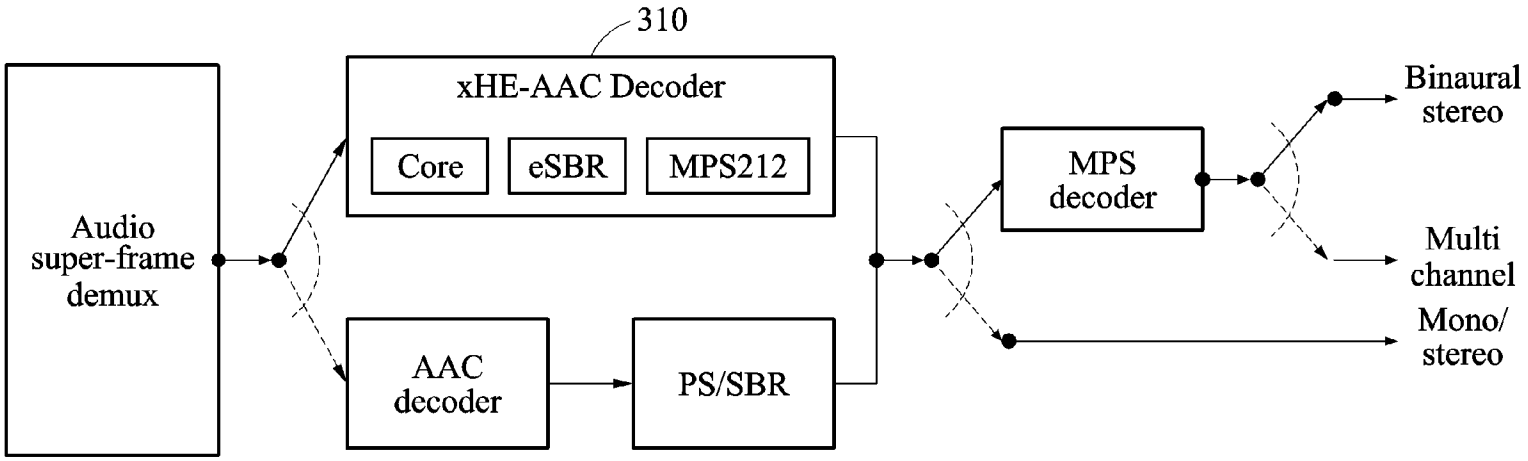
FIG. 3 is a diagram illustrating a decoding system of xHE-AAC according to an example embodiment.

FIG. 3 is a diagram illustrating a decoding system of xHE-AAC according to an example embodiment.

An xHE-AAC standard is defined as s a total of four profile levels, and each of the profile levels includes USAC profile level 2. The USAC profile level 2 is a profile supporting a decoding function for a mono and stereo signal. Thus, the xHE-AAC standard may need to decode a mono and stereo audio signal through USAC. A transmission standard described herein supports the xHE-AAC profile level 2.

That is, a decoding system described herein may need to decode a bit stream of a mono and stereo audio signal in USAC, and simultaneously decode a bit stream of a mono and stereo audio signal in HE-AAC v2. For supporting a multichannel signal, MPS technology may be applied, and thus backward compatibility with a mono and stereo audio signal may be maintained.

An example of the decoding system of xHE-AAC is illustrated in FIG. 3. An audio superframe received by the decoding system may be decoded selectively using an xHE-AAC based decoding method (first decoding method) and an existing AAC based decoding method (second decoding method). The decoding system may extract a decoding parameter from the received audio superframe, and determine a decoding method based on the extracted decoding parameter. That is, the decoding system may determine the decoding method for the audio superframe based on a preset condition, and decode an audio signal based on the determined decoding method.

Here, the decoding parameter to be extracted may be automatically determined based on a user parameter required for encoding the audio signal. The user parameter may include at least one of bit rate information of a codec for the audio signal, layout type information of the audio signal, and information as to whether MPS encoding is used for the audio signal.

When the decoding method for the received audio superframe is determined to be the first decoding method, the decoding system may perform core decoding on the received audio superframe, perform eSBR on an audio signal output by performing the core decoding, and perform MPS212 decoding on an audio signal output by performing the eSBR.

When the decoding method for the received audio superframe is determined to be the second decoding method, the decoding system may perform decoding on the received audio superframe using the second decoding method, and perform PS and SBR on an audio signal output by performing the second decoding method.

Here, the decoding system may determine whether the audio signal output as a result of performing the decoding on the received audio superframe is a multichannel audio signal or a binaural stereo signal for multichannel, and may perform MPS decoding when the audio signal is determined to be a multichannel audio signal or a binaural stereo signal for multichannel.

Figure 4:
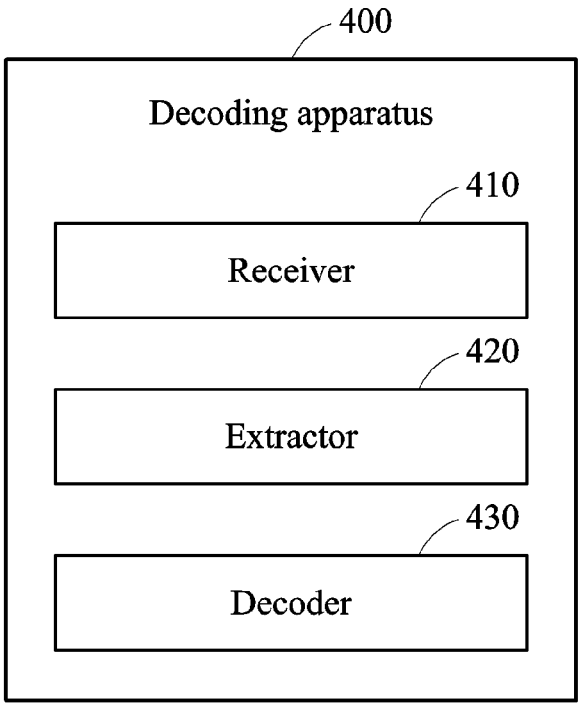
FIG. 4 is a diagram illustrating a decoding apparatus according to an example embodiment.

FIG. 4 is a diagram illustrating a decoding apparatus according to an example embodiment.

Referring to FIG. 4, a decoding apparatus 400 includes a receiver 410, an extractor 420, and a decoder 430. The receiver 410 may receive an audio superframe to be decoded. Here, the audio superframe to be received by the receiver 410 may include a header section including information about a number of borders of audio frames included in the audio superframe, information about a reservoir fill level of a first audio frame, a payload section including bit information of the audio frames included in the audio superframe, and a directory section including border location information of a bit string for each audio frame included in the audio superframe.

The extractor 420 may extract a decoding parameter from the audio superframe received through the receiver 410 to decode the audio superframe. Here, the decoding parameter to be extracted by the extractor 420 may be automatically determined based on a user parameter required for encoding an audio signal. The user parameter may include at least one of bit rate information of a codec for the audio signal, layout type information of the audio signal, and information as to whether MPS encoding is used for the audio signal.

The decoder 430 may decode the received audio superframe based on the decoding parameter extracted by the extractor 420. Here, when a decoding method for the received audio superframe is determined to be a first decoding method, the decoder 430 may perform core decoding on the received audio superframe, perform eSBR on an audio signal output by performing the core decoding, and perform MPS212 decoding on an audio signal output by performing the eSBR.

When the decoding method for the received audio superframe is determined to be a second decoding method, the decoder 430 may perform decoding on the received audio superframe using the second decoding method and perform PS and SBR on an audio signal output by performing the second decoding method.

An audio stream encoded through a first coding method may be configured as a single audio superframe in which a plurality of audio frames has no border therebetween, and be transmitted as the configured single audio superframe.

TABLE 1

| Syntax | No. of bits | Mnemonic |
|---|---|---|
| Audio_super_frame( ) | | |
| { | | |
| audio_coding | 2 | uimsbf |
| switch (audio_coding) { | | uimsbf |
| case xHE-AAC: | | |
| audio_mode | 2 | |
| audio_sampling_rate | 3 | uimsbf |
| codec_specific_config | 1 | uimsbf |
| xheaac_audio_super_frame( ); | | |
| case AAC: | | |
| heaac_audio_super_frame( ); | | |
| } | | |
| } | | |

Thus, before analyzing a transmitted audio superframe, syntactic information associated with a basic transmission audio frame may need to be extracted. Table 1 above illustrates a syntactic function including the syntactic information.

TABLE 2

| Index | audio_coding |
|---|---|
| 00 | AAC |
| 01 | Reserved |
| 10 | Reserved |
| 11 | xHE-AAC |

Table 2 above provides an audio coding method used to generate a transmission audio frame. Here, the transmission audio frame may be expressed by 2 bits to indicate an audio coding method being used.

For example, referring to Table 2, when the 2 bits expressing the transmission audio frame is 00, it may indicate that the transmission audio frame is encoded using an existing AAC based coding method. When the 2 bits expressing the transmission audio frame is 11, it may indicate that the transmission audio frame is encoded using an xHE-AAC based coding method. Thus, when decoding the transmission audio frame, whether the existing AAC based coding method or the xHE-AAC based coding method is to be used for a decoding apparatus may be determined based on such syntactic information.

TABLE 3

| Index | audio_mode(xHE-AAC) |
|---|---|
| 00 | mono |
| 01 | Reserved |
| 10 | Stereo |
| 11 | reserved |

In a case of decoding a transmission audio frame using a decoding apparatus based on an xHE-AAC based coding method, Table 3 above illustrates syntactic information to indicate xHE-AAC profile (audio mode) associated with the transmission audio frame. Here, the transmission audio frame may be expressed by 2 bits to indicate an audio coding method.

For example, as illustrated in Table 3, when the 2 bits expressing the transmission audio frame is 00, a coding mode for a mono audio signal may be determined. When the 2 bits expressing the transmission audio frame is 10, a coding mode for a stereo audio signal may be determined.

TABLE 4

| Index | audio_sampling_rate (xHE-AAC) |
|---|---|
| 000 | 12 |
| 001 | 19.6 |
| 010 | 24 |
| 011 | 25.6 |
| 100 | 28.8 |
| 101 | 35.2 |
| 110 | 38.4 |
| 111 | 48 |

In a case of decoding a transmission audio frame using a decoding apparatus in a xHE-AAC based coding method, Table 4 illustrates syntactic information associated with a sample frequency for decoding the transmission audio frame. Here, the transmission audio frame may be expressed by 3 bits of the sample frequency.

For example, as illustrated in Table 4, when the 3 bits of the transmission audio frame is 000, the decoding apparatus in the xHE-AAC based coding method may decode the transmission audio frame based on a 12 hertz (Hz) sample frequency. When the 3 bits of the transmission audio frame is 010, the decoding apparatus in the xHE-AAC based coding method may decode the transmission audio frame based on a 24 Hz sample frequency.

TABLE 5

| Index | audio_specific_config |
|---|---|
| 00 | xHE-AAC header not included |
| 01 | xHE-AAC header included |

In a case of decoding a transmission audio frame using a decoding apparatus in an xHE-AAC based coding method, Table 5 above illustrates syntactic information as to whether the transmission audio frame includes xHE-AAC header information. Here, the transmission audio frame may be expressed by 2 bits of the xHE-AAC header information.

For example, as illustrated in Table 5, when the 2 bits of the transmission audio frame is 00, it may indicate that the transmission audio frame may not include the xHE-AAC header information. When 2 bits of the transmission audio frame to is 01, it may indicate that the transmission audio frame may include the xHE-AAC header information.

As described above, a decoding apparatus and a decoding parameter may be determined based on bit stream information of an audio frame to be transmitted, and the decoding parameter may be automatically determined by a user parameter required for encoding an audio signal.

An audio codec bit rate: set a bit rate of an audio signal based on a transmission environment An audio layout type: a mono audio signal or a stereo audio signal Information as to whether MPS is used: provide backward compatibility with a multichannel service and a stereo signal When a broadcaster simply inputs a user parameter described in the foregoing, an audio encoding apparatus based on an xHE-AAC based coding method may automatically set a parameter for encoding. Most user parameters may be set as a static parameter to be transmitted, although some user parameter may change by a frame unit, for example, dynamic configuration information of SBR. However, most user parameters may be used without a change once being statically set. Static configuration information of the xHE-AAC based coding method may be defined as a syntactic function as follows. The following indicates a syntactic element to be statically defined to set an optimal encoder parameter value from user parameter information set by a broadcaster, and may start from "xheaacStaticConfig( )" and a decoder parameter value may be obtained from each piece of syntactic element information.

TABLE 6

| Syntax | No. of bits | Mnemonic |
|---|---|---|
| xheaacStaticConfig( ) | | |
| { | | |
| coreSbrFrameLengthIndexDABplus; | 2 | uimsbf |
| xHEAACDecoderConfig( ); | | |
| usacConfigExtensionPresent | 1 | uimsbf |
| if(usacConfigExtensionPresent == 1){ | | |
| UsacConfigExtension( ); | | |
| } | | |
| } | | |

NOTE:
"coreSbrFrameLengthIndexDABplus" is identical to coreSbrFrameLengthIndex−1 of USAC (e.g., coreSbrFrameLengthIndexDABplus == 0 is identical to coreSbrFrameLengthIndex == 1.)

Table 6 above illustrates a syntactic function including information to determine a form of a decoding apparatus. The form of the decoding apparatus may be set, starting from the syntactic function.

TABLE 7

| Syntax | No. of bits | Mnemonic |
|---|---|---|
| xHEAACDecoderConfig( ) | | |
| { | | |
| elemIdx == 0; | | |
| switch (audio_mode){ | | |
| case: '00' | | |
| usacElementType[elemIdx]= ID_USAC_SCE; | | |
| xHEAACSingleChannelElementConfig( ): | | |
| break; | | |
| case: '10' | | |
| usacElementType[elemIdx]= ID_USAC_CPE; | | |
| xHEAACChannelPairElementConfig( ) | | |
| break; | | |
| } | | |
| } | | |

TABLE 8

| Syntax | No. of bits | Mnemonic |
|---|---|---|
| UsacSingleChannelElementConfig(sbrRatioIndex) | | |
| { | | |
| noiseFiling | 1 | bsblf |
| if (sbrRatioIndex > 0) { | | |
| SbrConfig( ); | | |
| } | | |
| } | | |

Table 8 above illustrates a syntactic function providing information required for setting a decoding apparatus to decode a mono audio signal. The syntactic function and information may be the same as those defined in xHE-AAC. A "UsacCoreConfig" function may fetch syntactic information required to operate a decoding apparatus corresponding to core coding in xHE-AAC based coding method. In the xHE-AAC based coding method, only "noiseFilling" syntactic information that mainly affects a sound quality may be defined, and "Time-warpping tool (tw_mdct)" that requires a large quantity of operation may be defined not to be used.

TABLE 9

| Syntax | No. of bits | Mnemonic |
|---|---|---|
| UsacChannelPairElementConfig(sbrRatioIndex | | |
| ) | | |
| { | | |
| noiseFilling; | 1 | bsblf |
| if (sbrRatioIndex > 0) { | | |
| SbrConfig( ); | | |
| stereoConfigIndex; | 2 | uimsbf |
| } | | |
| else { | | |
| stereoConfigIndex = 0; | | |
| } | | |
| if (stereoConfigIndex > 0) { | | |
| Mps212Config(stereoConfigIndex | | |
| ); | | |
| } | | |
| } | | |

Table 9 above illustrates a syntactic function providing information required for setting a decoding apparatus to decode a stereo audio signal.

TABLE 10

| Syntax | No. of bits | Mnemonic |
|---|---|---|
| SbrConfig( ) | | |
| { | | |
| harmonicSBR; | 1 | bsblf |
| bs_interTes; | 1 | bsblf |
| bs_pvc; | 1 | bsblf |
| SbrDfltHeader( ); | | |
| } | | |

Table 10 above illustrates syntactic information defining a form of an SBR decoding apparatus for a xHE-AAC based coding method. "harmonicSBR" that mainly affects performance may parse syntactic information from bit information to be transmitted and use the parsed syntactic information, and may not use other tools that do not significantly affect the performance and increase complexity, for example, bs_interTes,bs_pvc.

TABLE 11

| Syntax | No. of bits | Mnemonic |
|---|---|---|
| SbrDfltHeader( ) | | |
| { | | |
| dflt_start_freq; | 4 | uimsbf |
| dflt_stop_freq; | 4 | uimsbf |
| dflt_header_extra1; | 1 | uimsbf |
| dflt_header_extra2; | 1 | uimsbf |
| if (dflt_header_extra1 == 1) { | | |
| dflt_freq_scale; | 2 | uimsbf |
| dflt_alter_scale; | 1 | uimsbf |
| dflt_noise_bands; | 2 | uimsbf |
| } | | |
| if (dflt_header_extra2 == 1) { | | |
| dflt_limiter_bands; | 2 | uimsbf |
| dflt_limiter_gains; | 2 | uimsbf |
| dflt_interpol_freq; | 1 | uimsbf |
| dflt_smoothing_mode; | 1 | uimsbf |
| } | | |
| } | | |

Table 11 above illustrates syntactic information associated with settings for decoding an SBR parameter, which is identical to a syntax of USAC without an additional change.

TABLE 12

| Syntax | No. of bits | Mnemonic |
|---|---|---|
| Mps212Config(stereoConfigIndex) | | |
| { | | |
| bsFreqRes; | 3 | uimsbf |
| bsFixedGainDMX | 3 | uimsbf |
| bsTempShapeConfig; | 2 | uimsbf |
| bsHighRateMode; | 1 | uimsbf |
| bsPhaseCoding; | 1 | uimsbf |
| bsOttBandsPhasePresent; | 1 | uimsbf |
| if (bsOttBandsPhasePresent) { | | |
| bsOttBandsPhase; | 5 | uimsbf |
| } | | |
| if (bsResidualCoding) { | | |
| bsResidualBands; | 1 | uimsbf |
| bsOttBandsPhase = | | |
| max(bsOttBandsPhase,bsResidualBands); | | |
| bsPseudoLr; | 1 | uimsbf |
| } | | |
| if (bsTempShapeConfig == 2) { | | |
| bsEnvQuantMode; | 1 | uimsbf |
| } | | |
| } | | |

Table 12 above illustrates a syntactic function to set a form of an MPS212 decoding apparatus. In an xHE-AAC based coding method, an MPS form may be combined with an SBR coding mode based on a bit rate to be variously set. Each piece of the syntactic information may be the same as in xHE-AAC, with an exception that syntactic information associated with "bsDecorrConfig" is not to be transmitted because an MPS module of the xHE-AAC based coding method is permanently "bsDecorrConfig==0."

Figure 5:
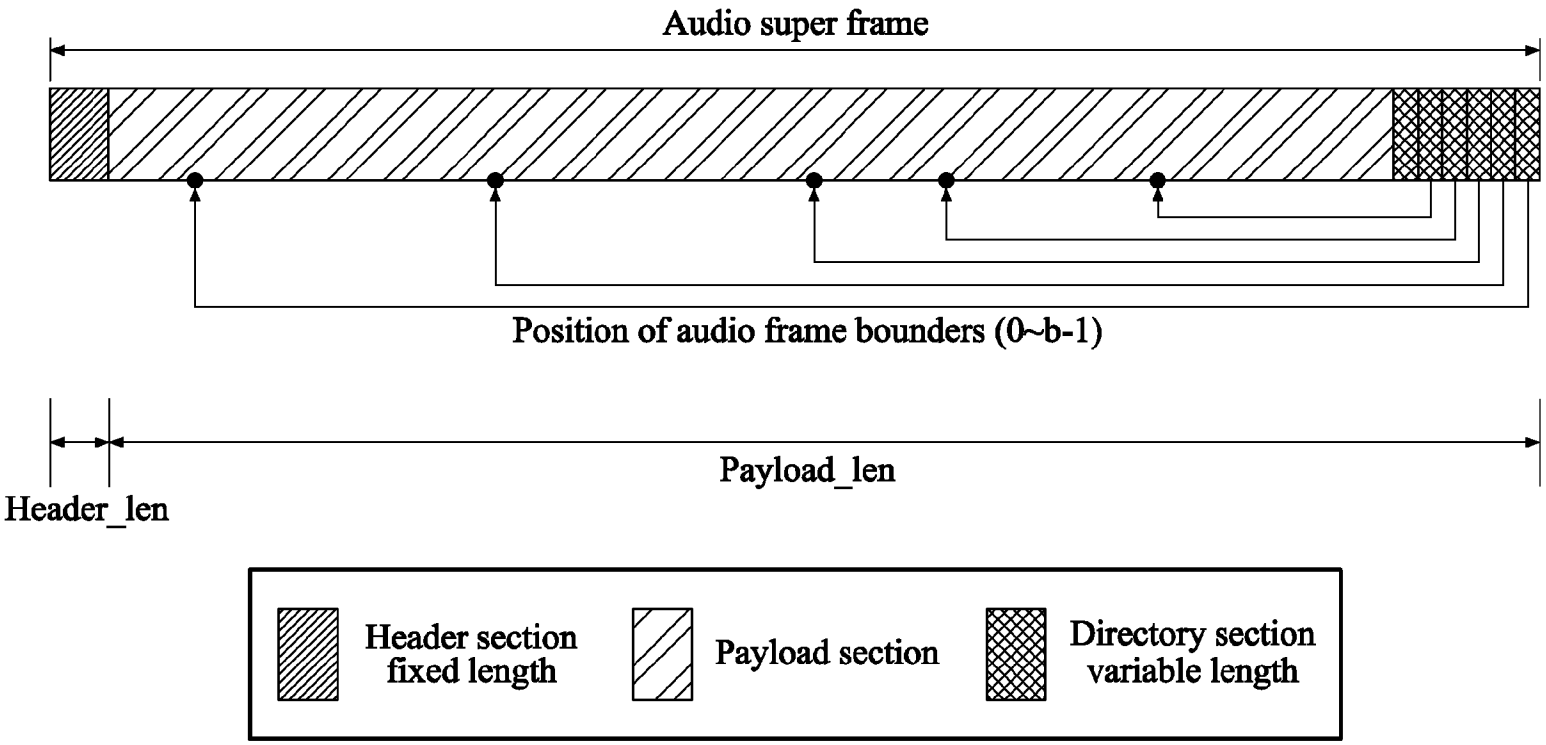
FIG. 5 is a diagram illustrating an example of a structure of an xHE-AAC superframe according to an example embodiment.

FIG. 5 is a diagram illustrating an example of a structure of an xHE-AAC superframe according to an example embodiment.

The encoding apparatus 200 described herein may configure, as an audio superframe of a fixed size, an audio stream generated as a result of encoding a received audio signal. Here, the audio stream encoded through an xHE-AAC based coding method may be configured as a single audio superframe in which a plurality of audio frames has no borders, and the configured audio superframe may be transmitted.

The audio superframe configured through the xHE-AAC based coding method may have a fixed size, and include a header section, a payload section, and a directory section.

The header section may include information about a number of borders of the audio frames and information about a bit reservoir fill level of a first audio frame.

The payload section including bit information of an audio frame may store a bit string in a byte unit. The audio frames may be successively attached without an additional padding byte in the borders among the audio frames and irrespective of a length of a bit string for each audio frame.

The directory section may include border location information of a bit string for each audio frame. Here, the location information may be defined only in a corresponding superframe, and may indicate a location based on byte unit counts and provide location information about 'b' frame borders extracted from the header section.

TABLE 13

| Syntax | No. of bits | Mnemonic |
|---|---|---|
| xheaac_super_frame( ) | | |
| { | | |
| bsFrameBorderCount | 12 | |
| bsBitReservoirLevel | 4 | |
| FixedHeaderCRC | 8 | |
| if(codec_specific_config) | | |
| xheaacStaticConfig( ); | | |
| for(n=0;n<bsFrameBorderCount;n++){ | | |
| xheaac_au[n] | 8 × u[n] | |
| xheaac_crc[n] | 4 | |
| } | | |
| for (n=0;n<b;n++){ | | |
| auBorderIndx[b−n−1] = bsFrameBorderIndx | | |
| bsFrameBorderCount | | |
| } | | |
| } | | |

In Table 13 above, "bsFrameBorderCount" is information indicating a number of borders of an audio frame bit string that may be loaded on a payload section of a single audio superframe to be sent. When a bit string of a last audio frame to be included in the audio superframe is completely included in the audio superframe, a count number of borders of audio frames may be equal to a number of audio frames to be transmitted to the payload section.

"bsBitReservoirLevel" may indicate a bit reservoir fill level of a first audio frame included in the audio superframe. When there is no border included among the audio frames, it may indicate an entire bit reservoir fill level of the audio superframe. "FixedHeaderCRC" may allocate 8 bits to a cyclic redundancy check (CRC) code for the header section. "bsFrameBorderIndex" may provide the location information, in reverse order, from the border of the last audio frame included in the audio superframe. Here, index information associated with the location information may be indicated using 14 bits. "bsFrameBorderCount" may provide information about a border count of the audio frames. Thus, despite occurrence of an error in header information, a plurality of pieces of border count information exists, and thus a decoding apparatus may readily discover a border among the audio frames.

Figure 6:
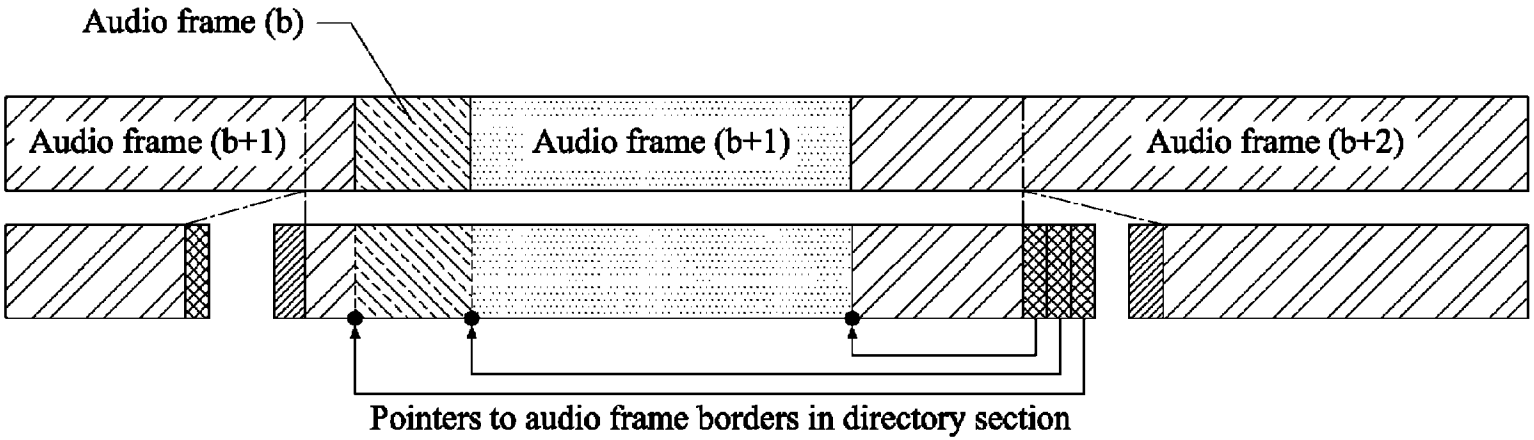
FIG. 6 is a diagram illustrating an example of a configuration of a superframe payload of a plurality of xHE-AAC audio frames according to an example embodiment.

FIG. 6 is a diagram illustrating an example of a configuration of a superframe payload of a plurality of xHE-AAC audio frames according to an example embodiment.

An encoding apparatus based on an xHE-AAC based coding method may express, as a bit string, a result of receiving an audio signal in an actually fixed audio frame unit as an input and encoding the received audio signal, and configure an audio frame to be transmitted to a payload section of an audio superframe. Here, the bit string may be configured in a byte unit, and include a 16 bit CRC code.

An xHE-AAC access unit (AU) may indicate information to be used to generate an audio signal actually using a decoding apparatus based on the xHE-AAC based coding method. Here, encoding may be performed based on a variable bit rate of the xHE-AAC based coding method, and thus audio frame signals of an equal size may have variable AU sizes. A first bit of the AU may relate to "usacIndependencyFlag." When usacIndependencyFlag is 1, an audio signal in a current audio frame may be decoded without information of a previous audio frame. Thus, at least one audio frame may need to exist in a single audio superframe, and at least one unsacIndependencyFlag may need to be 1.

An xHE-AAC AU CRC may generate a CRC code for the xHE-AAC AU, and the CRC code may be generated by allocating 16 bits to each audio frame.

Audio frame signals successively input may be each encoded by the xHE-AAC based coding method and converted to an AU. Although a fixed bit rate may be ensured in a long section, a number of bits required for each audio frame may not be fixed. Thus, an AU length of each audio frame may be defined to be differently in the audio superframe. That is, defining AU lengths of the audio frames to be different from one another in the audio superframe may be to enhance a quality of an audio signal to be encoded. Thus, the encoding apparatus based on the xHE-AAC based coding method may determine an AU of each audio frame by referring to a bit reservoir fill level to allocate greater bits to an audio frame having a high level of difficulty in a long section and allocate lower bits to an audio frame that is not perceptually significant. Transmitting such a bit reservoir fill level to an audio decoding apparatus may reduce an AU buffer size to be input and reduce an additional delay time of the audio decoding apparatus.

The encoding apparatus based on the xHE-AAC based coding method may generate a superframe for transmission. For a byte arrangement of a bit string of an audio frame, the xHE-AAC AU may fill a null bit to correspond to a byte unit. For example, when a bit string of an audio frame is 7 bits, the encoding apparatus based on the xHE-AAC based coding method may insert (or fill) one null bit to form 1 byte (8 bits).

A border of an audio frame may not need to correspond to a border of an audio superframe. A bit string of an audio frame AU may be connected to a variable bit string, in order, based on an input of an audio signal, and may be divided based on a fixed bit rate of the audio superframe and then be transmitted.

Thus, the single audio superframe may include a variable number of audio frame AUs. However, an audio frame AU may be extracted and decoded based on AU border information extracted from header information and directory information of the audio superframe.

When a bit string of an AU of an audio frame does not span 1 byte or more of the single audio superframe, the directory section of the single audio superframe may not include syntactic information associated with frame border information of the audio frame. In detail, AU border information associated with the audio frame less than 3 bytes including 2 bytes associated with the frame border information of the audio frame may not be extracted from the single audio superframe.

Thus, when a bit string of an AU of an audio frame does not span 1 byte or more of the single audio superframe, the frame border information of the audio frame may be expressed in an audio superframe subsequent to the single audio superframe.

Here, the subsequent audio superframe may include last frame border information of the directory section. For example, when the last frame border information is expressed as 0xFFF in the subsequent audio superframe, it may indicate that last byte information of an AU of the last audio frame is included in the single audio superframe. Thus, the audio decoding apparatus may need to permanently buffer 2 byte data in the payload section of the single audio superframe to decode the last audio frame.

A bit reservoir fill controller may be a mechanism that is generally used in MPEG coding. Although a variable bit rate may be indicated in a short section, a fixed bit rate may be output in a long section, and thus an optimal sound quality may be provided in a given section. Thus, when a bit reservoir fill level is sufficiently high and a bit is additionally required for coding current audio frames, the xHE-AAC based coding method may allocate the bit and lower the bit reservoir fill level. Conversely, when a bit is not required for coding the current audio frames, the xHE-AAC based coding method may not allocate the bit, but increase the bit reservoir fill level in order to use the bit in a section requiring the bit.

According to example embodiments, syntactic information and a frame structure for additional application of USAC to existing DAB+ may be provided, and thus a USAC-based DAB+ service may be enabled.

The units described herein may be implemented using hardware components and software components. For example, the hardware components may include microphones, amplifiers, band-pass filters, audio to digital converters, non-transitory computer memory and processing devices. A processing device may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such a parallel processors.

The software may include a computer program, a piece of code, an instruction, or some combination thereof, to independently or collectively instruct or configure the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums. The non-transitory computer readable recording medium may include any data storage device that can store data which can be thereafter read by a computer system or processing device.

The methods according to the above-described example embodiments may be recorded in non-transitory computer-readable media including program instructions to implement various operations of the above-described example embodiments. The media may also include, alone or in combination with the program instructions, data files, data structures, and the like. The program instructions recorded on the media may be those specially designed and constructed for the purposes of example embodiments, or they may be of the kind well-known and available to those having skill in the computer software arts. Examples of non-transitory computer-readable media include magnetic media such as hard disks, floppy disks, and magnetic tape; optical media such as CD-ROM discs, DVDs, and/or Blue-ray discs; magneto-optical media such as optical discs; and hardware devices that are specially configured to store and perform program instructions, such as read-only memory (ROM), random access memory (RAM), flash memory (e.g., USB flash drives, memory cards, memory sticks, etc.), and the like. Examples of program instructions include both machine code, such as produced by a compiler, and files containing higher level code that may be executed by the computer using an interpreter. The above-described devices may be configured to act as one or more software modules in order to perform the operations of the above-described example embodiments, or vice versa.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents.

Therefore, the scope of the disclosure is defined not by the detailed description, but by the claims and their equivalents, and all variations within the scope of the claims and their equivalents are to be construed as being included in the disclosure.

What is claimed is:

1. An audio signal encoding method performed by at least processor comprising:

wherein the processor configured to:

receive an audio signal;

determine a coding method for the received audio signal for each audio superframe of the audio signal; and encode the audio signal based on the determined coding method for the each audio superframe, wherein the coding method comprises a first coding method associated with USAC (Unified Speech Audio Coding) and a second coding method associated with existing advanced audio coding (AAC), and when the coding method is determined as first encoding method, wherein the processor configured to:

perform MPS212 encoding, a tool for the MPS encoding, on the received audio signal;

perform enhanced spectral band replication (eSBR) on an audio signal output from the performing of the MPS212 encoding; and performing core encoding on an audio signal output from the performing of the eSBR, when the coding method is determined as second encoding method, wherein the processor configured to:

perform parametric stereo (PS) and spectral band replication (SBR) on the received audio signal; and performing encoding on an audio signal output from the performing of the PS and SBR using the second coding method.

2. The audio signal encoding method of claim 1, wherein the processor is configured to:

determine a coding method for the received audio signal by determining whether a type of the received audio signal is a multichannel audio signal or a mono or stereo audio signal; and perform moving picture experts group (MPEG) surround (MPS) encoding when the received audio signal is determined to be the multichannel audio signal.

3. The audio signal encoding method of claim 1, wherein the audio superframe comprises a header section comprising information about a number of borders of audio frames comprised in the audio superframe and information about a reservoir fill level of a first audio frame, a payload section comprising bit information of the audio frames comprised in the audio superframe, and a directory section comprising border location information of a bit string for each audio frame comprised in the audio superframe.

4. The audio signal encoding method of claim 1, wherein the processor is configured to:

apply forward error correction (FEC) to the audio superframe for correcting a bit error occurring when the audio superframe is being transmitted through a communication line.

5. An audio signal decoding method performed by at least processor comprising:

wherein the processor configured to:

receive an audio signal including an audio superframe;

determine a decoding method for the audio superframe of the audio signal; and decode the audio superframe based on the determined decoding method for the audio superframe, wherein the decoding method comprises a first decoding method associated with USAC (Unified Speech Audio Coding) and a second decoding method associated with existing advanced audio coding (AAC), and when the coding method is determined as first decoding method, wherein the processor configured to:

perform core decoding on the received audio superframe when the decoding method for the received audio superframe is determined to be the first decoding method;

perform enhanced spectral band replication (eSBR) on an audio signal output from the performing of the core decoding; and perform MPS212 decoding on an audio signal output from the performing of the eSBR, when the coding method is determined as second decoding method, wherein the processor configured to:

perform decoding on the received audio superframe using the second decoding method; and perform parametric stereo (PS) and spectral band replication (SBR) on an audio signal output from the performing of the second decoding method.

6. The audio signal decoding method of claim 5, wherein the processor is configured to:

extract a decoding parameter from the received audio superframe; and determine at least one decoding method of the first decoding method and the second decoding method based on the extracted decoding parameter.

7. The audio signal decoding method of claim 6, wherein the decoding parameter is automatically determined based on a user parameter used for encoding the audio signal, wherein the user parameter comprises at least one of bit rate information of a codec for the audio signal, layout type information of the audio signal, and information as to whether moving picture experts group (MPEG) surround (MPS) encoding is used for the audio signal.

8. The audio signal decoding method of claim 5, wherein the audio superframe comprises a header section comprising information about a number of borders of audio frames comprised in the audio superframe and information about a reservoir fill level of a first audio frame, a payload section comprising bit information of the audio frames comprised in the audio superframe, and a directory section comprising border location information of a bit string for each audio frame comprised in the audio superframe.

9. An audio signal decoding apparatus comprising:

at least processor configured to:

receive an audio signal including an audio superframe;

determine a decoding method for the audio superframe of the an audio signal; and decode the audio superframe based on the determined decoding method for the audio superframe, wherein the decoding method comprises a first decoding method associated with USAC (Unified Speech Audio Coding) and a second decoding method associated with existing advanced audio coding (AAC), and when the coding method is determined as first decoding method, wherein the processor configured to:

perform core decoding on the received audio superframe when the decoding method for the received audio superframe is determined to be the first decoding method;

perform enhanced spectral band replication (eSBR) on an audio signal output from the performing of the core decoding; and perform MPS212 decoding on an audio signal output from the performing of the eSBR, when the coding method is determined as second decoding method, wherein the processor configured to:

perform decoding on the received audio superframe using the second decoding method; and perform parametric stereo (PS) and spectral band replication (SBR) on an audio signal output from the performing of the second decoding method.

10. The audio signal decoding apparatus of claim 9, wherein the processor is configured to extract a decoding parameter from the received audio superframe, and determine at least one decoding method of the first decoding method and the second decoding method based on the extracted decoding parameter.

11. The audio signal decoding apparatus of claim 10, wherein the decoding parameter is automatically determined based on a user parameter used for encoding the audio signal, wherein the user parameter comprises bit rate information of a codec for the audio signal, layout type information of the audio signal, and information as to whether moving picture experts group (MPEG) surround (MPS) encoding is used for the audio signal.

* * * * *